US007607419B2

(12) United States Patent
Rumpf

(10) Patent No.: US 7,607,419 B2
(45) Date of Patent: Oct. 27, 2009

(54) FUEL DELIVERY UNIT

(75) Inventor: Bernd Rumpf, Nidderau-Windecken (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 12/291,638

(22) Filed: Nov. 12, 2008

(65) Prior Publication Data

US 2009/0126699 A1 May 21, 2009

(30) Foreign Application Priority Data

Nov. 16, 2007 (DE) ..... 10 2007 054 857

(51) Int. Cl.
*F02M 37/04* (2006.01)

(52) U.S. Cl. ..... 123/509; 417/423.14

(58) Field of Classification Search ..... 123/509, 123/510, 514, 516; 417/423.14
See application file for complete search history.

(56) References Cited

U.S. PATENT DOCUMENTS 5,076,920 A * 12/1991 Danowski et al. ..... 210/243
5,647,330 A * 7/1997 Sawert et al. ..... 123/509
6,047,685 A * 4/2000 Schelhas et al. ..... 123/510
6,206,035 B1 * 3/2001 Wehner et al. ..... 137/565.16
6,435,163 B1 * 8/2002 Fauser et al. ..... 123/509

* cited by examiner

*Primary Examiner*—Stephen K Cronin
*Assistant Examiner*—J. Page Hufty
(74) *Attorney, Agent, or Firm*—Cohen Pontani Lieberman & Pavane LLP

(57) ABSTRACT

A fuel delivery unit for delivering fuel from a fuel container to an internal combustion engine of a motor vehicle, comprising a plurality of components, with the components being a flange for closing an opening in the fuel container, a splash pot which is connected to the flange by means of supporting elements a fuel pump which is arranged in said splash pot, a fuel filter, a pressure regulator, a filling level sensor and a pump pre-filter, and means for connecting each individual component to a ground potential of the motor vehicle. Components through and around which fuel flows are connected to the ground potential by means of at least two electrically conductive connections.

11 Claims, 2 Drawing Sheets

FUEL DELIVERY UNIT

BACKGROUND OF THE INVENTION

1. Field of the Invention

The subject matter of the invention is a fuel delivery unit for delivering fuel from a fuel container to an internal combustion engine of a motor vehicle, comprising a flange for closing an opening in the fuel container, a splash pot which is connected to the flange by means of supporting elements, a fuel pump which is arranged in said splash pot, a fuel filter, a pressure regulator, a filling level sensor and a pump pre-filter, and means for connecting each individual component to a ground potential of the motor vehicle.

2. Description of the Related Art

Electrostatic charges may form in components which are situated in fuel or around or through which fuel flows. The formation of electrostatic charges depends on the electrical conductance of the fuel used, the external conditions, for example humidity, and the flow rate of the fuel around or through the corresponding component. Depending on the type and size of the electrostatic charge and the conditions inside the fuel container, for example oxygen content, there is a corresponding risk of electrostatic charges being reduced by means of a flashover. In a worst-case scenario, such a flashover can lead to ignition of the fuel mixture. In order to prevent flashovers, an attempt is made to reduce electrostatic charges before the flashover voltage is reached.

To this end, it is known to electrically conductively connect the corresponding component to the ground potential of the motor vehicle. This is achieved, in particular, by the component being connected directly to the ground potential. Therefore, in the case of a fuel pump, the electrical connection lines of said fuel pump are used to discharge electrostatic charges.

In the case of components without their own electrical connection lines, it is possible to discharge electrostatic charges by connecting the corresponding component to the ground potential of the motor vehicle directly via an electrical line. This manner of discharging electrostatic charges is particularly cost-intensive on account of the additional outlay on material, assembly and laying of the electrical line.

A further option is to electrically conductively connect the component to another component which has means for discharging electrostatic charges. Therefore, a pressure regulator can be electrically conductively formed with the metal housing of a fuel pump in order to discharge electrostatic charges. The electrically conductive connection can be an electrical line or a conductive material, for example metal or electrically conductive plastic. A critical disadvantage of this series connection of components which are electrically conductively connected to one another is that the risk of flashover greatly increases when the electrical connection to ground potential is interrupted. The reason for the greatly increased risk is that, on account of the interruption, the individual capacitances of the disconnected components add up to form a total capacitance.

SUMMARY OF THE INVENTION

The invention is therefore based on providing a fuel delivery unit which is reliably protected against electrostatic charges, with the intention being to keep the outlay or cost of discharging electrostatic charges as low as possible.

According to the invention, the object is achieved in that components through and around which fuel flows are connected to the ground potential by at least two electrically conductive connections.

The provision of at least two electrically conductive connections to a ground potential ensures that electrostatic charges of components through and around which fuel flows are reliably discharged even when one of the electrically conductive connections is interrupted. This prevents the build-up of dangerous total capacitances. The apparatus according to the invention thus exhibits a significantly higher degree of safety.

Electrostatic charges are discharged particularly well with an electrically conductive connection in the form of an electrical line or by means of a metal-to-metal connection. The advantage of the electrically conductive connection in the form of an electrical line, preferably a cable or wire, is that the electrical line can be connected by means of a force-fitting, cohesive connection or the like. This manner of connection precludes the danger of contact resistances forming, which can impair the discharge of charges.

In one embodiment, at least one of the electrically conductive connections is established from an electrically conductive plastic to a metal. This has the advantage that electrically conductive connections are also possible between components comprising different materials.

In another embodiment, electrostatic charges are discharged by at least one electrically conductive connection from an electrically conductive plastic to an electrically conductive plastic. A connection of this type has the advantage that the use of plastic provides improved corrosion-resistance in the fuel and a lower weight together with improved processability.

The number of electrically conductive connections can be reduced in the case of a fuel delivery unit according to one embodiment in that a further component is interconnected to at least one of the electrically conductive connections of a component to the ground potential.

A plastic based on polyoxymethylene (POM) or polyamide (PA) with admixed electrically conductive constituents, in particular metal or carbon, has proven particularly advantageous as the electrically conductive plastic. Both POM and PA are further distinguished by a very high degree of resistance to fuels.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is described in the text which follows using an exemplary embodiment. In the drawing.

DETAILED DESCRIPTION OF THE PRESENTLY PREFERRED EMBODIMENTS

Figure 1:
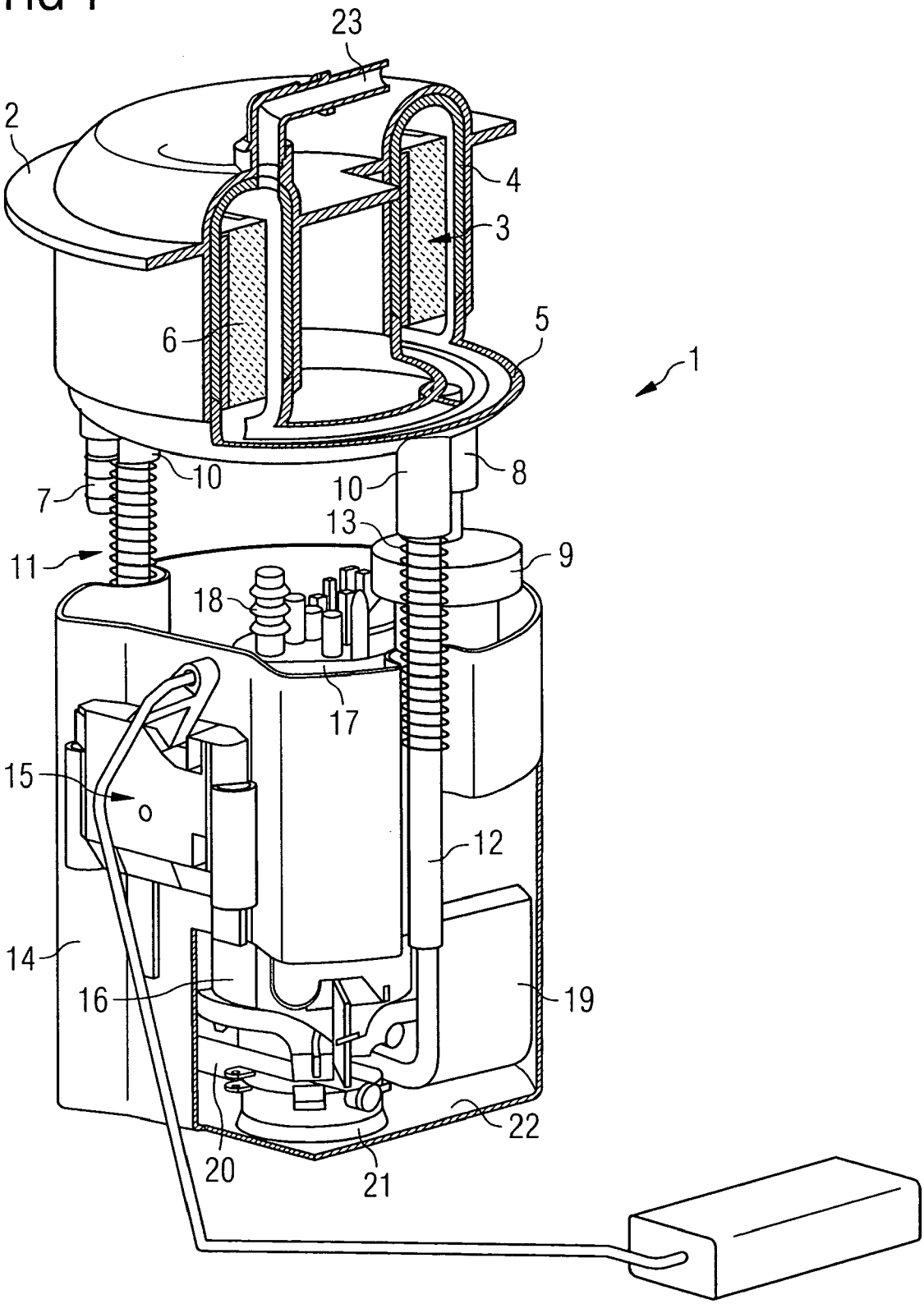
FIG. 1 is a fuel delivery unit according to one embodiment of the invention.

The fuel delivery unit 1 in FIG. 1 is illustrated partly in section to better illustrate the components. The fuel delivery unit 1 comprises a flange 2 which is formed in such a way that it closes an opening in a fuel container (not illustrated) into which the fuel delivery unit 1 is inserted. The flange 2 accommodates a fine filter 3 which is in the form of a fuel filter and comprises a housing upper part 4 and a housing lower part 5.

The two housing parts 4, 5 enclose the filter element 6. The housing lower part 5 has a first connection nozzle 7 and a second connection nozzle 8 into which a pressure regulator 9 is inserted.

Further receptacles 10, into which supporting elements 11 are inserted, are arranged on the housing lower part 5. The supporting elements 11 in each case comprise a pipe 12 around which a helical spring 13 is arranged. Those regions of the pipes 12 which extend away from the flange 2 are connected to a splash pot 14 by means of guides. The helical springs 13 are supported on the flange 2 and on the guides of the splash pot 14, so that the splash pot 14 is prestressed against the base of the fuel container.

A filling level sensor 15 for determining the quantity of fuel in the fuel container is fixed to the splash pot 14. A pump holder 16 holding a fuel pump 17 is fixed in the splash pot 14. The fuel pump 17 has an outlet connection nozzle 18 which is connected to a connection nozzle 8 of the housing lower part 5 via a forward-feed line (not illustrated). The fuel pump 17 is connected to a pump pre-filter 19 and a suction jet pump 20. The suction jet pump 20 has a seal 21 which surrounds the inlet opening (not illustrated) in the base 22 of the splash pot 14 and decouples the suction jet pump 20 from the splash pot 14.

During operation of the fuel delivery unit 1, the suction jet pump 20 draws fuel from the fuel container and delivers it to the splash pot 14. The suction jet pump 20 is driven by the fuel pump 17 by a partial quantity of the fuel delivered by the fuel pump 17 being supplied to the suction jet pump 20 as a propulsion jet. The fuel pump 17 draws fuel from the splash pot 14 via the pump pre-filter 19 and delivers said fuel to the fine filter 3 via the outlet connection nozzle 18 and the forward-feed line. The filtered fuel is delivered further to the internal combustion engine (not illustrated) via a forward-feed connection nozzle 23. Excess fuel delivered by the fuel pump 17 is returned to the splash pot 14 via the pressure regulator 9.

Figure 2:
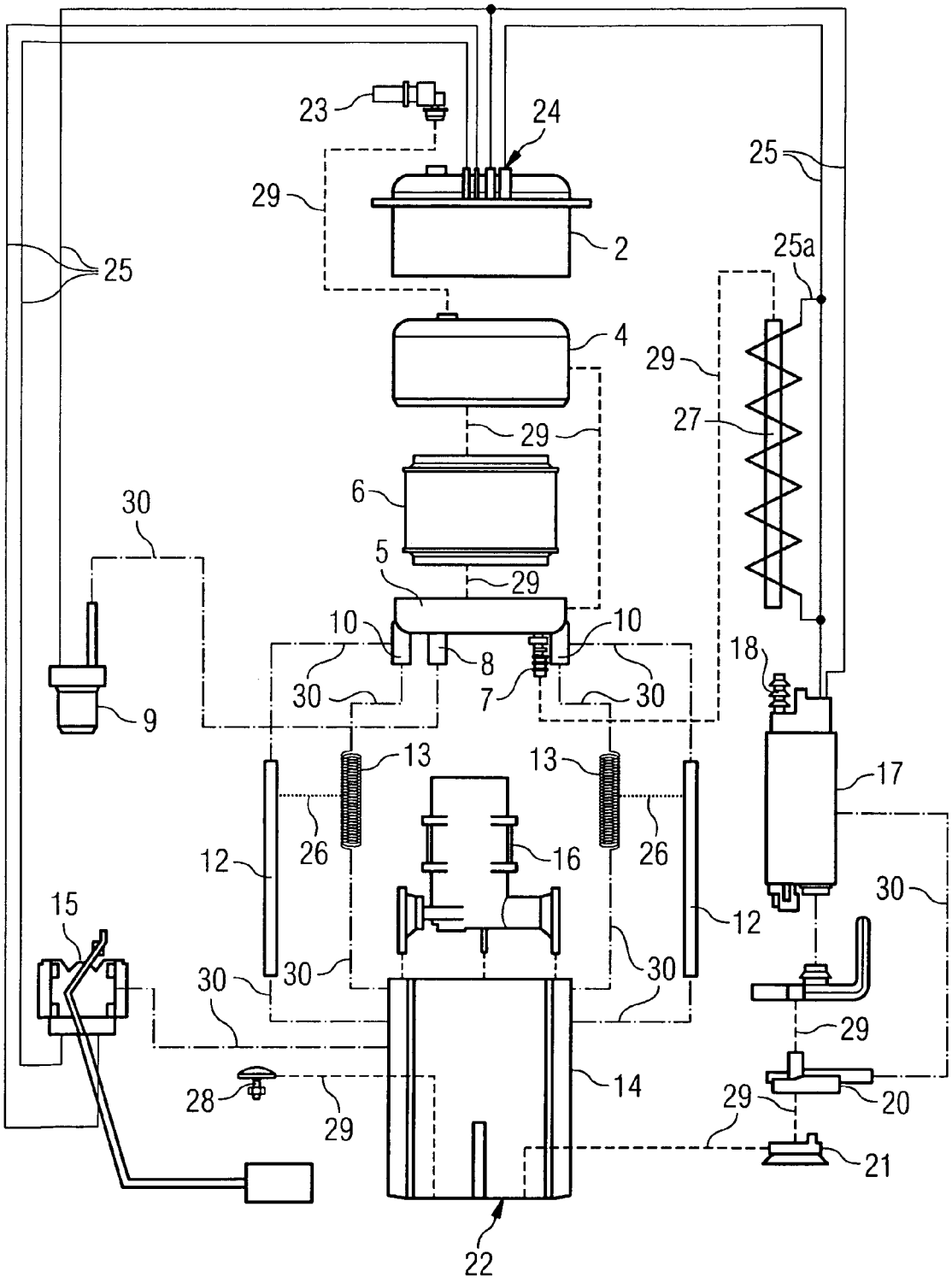
FIG. 2 is a basic circuit diagram of the fuel delivery unit from FIG. 1.

FIG. 2 shows an exploded illustration of the individual components of the fuel delivery unit 1. The lines between the individual components indicate the individual electrically conductive connections, with the line type indicating the type of electrically conductive connection. Each component has at least two electrically conductive connections. The ground potential is applied to the schematically illustrated plug 24.

Both the filling level sensor and the fuel pump 17 are connected to the ground potential by way of the plug 24 on the flange 2 via their electrical lines 25 (illustrated as solid lines). The pressure regulator 9, which comprises metal, is likewise connected to the ground potential by way of an electrical line 25.

The components pipe 12 and helical spring 13 which comprise metal have an electrically conductive connection of metal to metal, this connection being illustrated as dotted line 26.

The filter housing components 4, 5, filter element 6, pump holder 16, housing for filling level sensor 15, splash pot 14, pump pre-filter 19, suction jet pump 20, seal 21, forward-feed line 27 and the first filling valve 28 which is arranged in the base 22 of the splash pot 14 are conductive plaster, preferably POM with admixed carbon in the form of carbon black. Electrically conductive connections between components comprising electrically conductive plastic are illustrated by way of dashed lines 29. The electrically conductive connections between components comprising electrically conductive plastic and components comprising metal are illustrated by way of dash-dotted lines 30.

Furthermore, still further electrically redundant connections 25*a* are also possible since the electrical lines are arranged around the forward-feed line 27 in the form of a coil.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A fuel delivery unit for delivering fuel from a fuel container to an internal combustion engine of a motor vehicle, comprising a plurality of components including:

a flange for closing an opening in the fuel container;

a splash pot which is connected to the flange by supporting elements;

a fuel pump which is arranged in said splash pot;

a fuel filter filtering fuel output by said fuel pump;

a pressure regulator returning excess fuel to the splash pot;

a filling level sensor determining a quantity of fuel in the fuel container;

a pump pre-filter connected to the fuel pump; and means for connecting each of said plurality of components to a ground potential of the motor vehicle by at least two distinct electrically conductive connections.

2. The fuel delivery unit according to in claim 1, wherein at least one of the electrically conductive connections is selected from the group consisting of an electrical line and a metal-to-metal connection.

3. The fuel delivery unit according to in claim 1, wherein at least one of the electrically conductive connections is a connection between an electrically conductive plastic and metal.

4. The fuel delivery unit according to in claim 1, wherein at least one of the electrically conductive connections is established between electrically conductive plastics.

5. The fuel delivery unit according claim 1, wherein a further component is interconnected in at least one of the electrically conductive connections between said components and the ground potential.

6. The fuel delivery unit according to claim 3, wherein the electrically conductive plastic is a polyoxymethylene, blended with electrically conductive constituents.

7. The fuel delivery unit according to claim 3, wherein the electrically conductive plastic is a polyamide blended with electrically conductive constituents.

8. The fuel delivery unit according to claim 6, wherein the electrically conductive constituents are at least one of metal and carbon.

9. The fuel delivery unit according to claim 7, wherein the electrically conductive constituents are at least one of metal and carbon.

10. The fuel delivery unit according to claim 1, wherein at least one of said fuel delivery unit components is an electrically conductive plastic.

11. The fuel delivery unit according to claim 10, wherein the electrically conductive plastic is at least one of polyamide or polyoxymethylene, and the electrically conductive constituents are at least one of metal and carbon.

* * * * *